US006386734B1

(12) United States Patent
Huang

(10) Patent No.: US 6,386,734 B1
(45) Date of Patent: May 14, 2002

(54) THREE DIMENSIONAL FOLDABLE DECORATIVE LAMP STRUCTURE

(75) Inventor: Peter K. H. Huang, Taipei (TW)

(73) Assignee: Shining Blick Enterprises Co., Ltd. (TW)

( * ) Notice: Subject to any disclaimer, the term of this patent is extended or adjusted under 35 U.S.C. 154(b) by 0 days.

(21) Appl. No.: 09/610,371

(22) Filed: Jul. 5, 2000

(51) Int. Cl.[7] ..... F21V 21/00
(52) U.S. Cl. ..... 362/249; 362/252
(58) Field of Search ..... 362/249, 252, 362/806, 121, 123, 122, 807, 808

(56) References Cited

U.S. PATENT DOCUMENTS 5,629,057 A * 5/1997 Wang et al. ..... 428/9
5,645,343 A * 7/1997 Rinehimer ..... 362/252
5,876,111 A * 3/1999 Wu ..... 362/250
6,070,991 A * 6/2000 Rumpel ..... 362/249
6,135,617 A * 10/2000 Lai ..... 362/249
6,217,192 B1 * 4/2001 Stratton ..... 362/249

* cited by examiner

*Primary Examiner*—Sandra O'Shea
*Assistant Examiner*—Jacob Y. Choi
(74) *Attorney, Agent, or Firm*—Troxell Law Office PLLC

(57) ABSTRACT

A decorative lamp structure having frame bars, and upper and lower positioning disks for connecting the frame bars. The upper and lower positioning disks are provided with recesses in the same number as the number of frame bars, the inner bottom surface of each recess having a through hole. The frame bars each have on both the upper and lower ends a base which is prolonged to form integrally an engaging pin. The engaging pins and the recesses are mutually pivotally connected in a primary in-position stage and are fixedly connected in a second stage. The lamp structure can be folded up into a flat, smaller volume for packaging, transporting and storage in the primary in-position stage and may be conveniently to be pressed into the second stage.

4 Claims, 11 Drawing Sheets

THREE DIMENSIONAL FOLDABLE DECORATIVE LAMP STRUCTURE

BACKGROUND OF THE INVENTION

1. Field of the Invention

The present invention is related to a decorative lamp structure having a plurality of lamps which can be folded up for packaging when in its primary in-position stage, or can be stretched out to form a three dimensional construction by a user.

2. Description of the Prior Art

A conventional spherical decorative lamp is in the shape of a sphere constructed with a plurality of semi-circular frame bars in cooperation with upper and lower positioning disks in order to form the shape of the sphere, wherein, each of the semi-circular frame bars can be mounted on a lateral edge thereof a plurality of lamps with lamp sockets. In this way, when the lamps are turned on for lightening on the spherical body, a bright shining decorative light emitting sphere is obtained.

Spherical decorative lamps mostly have their upper and lower positioning disks connected fixedly with each other, i.e., they are spheres when they are sent out from a factory. However, such a spherical decorative lamp in a fixed shape occupies larger volume, this makes trouble in transporting and packaging, thus makes higher cost. And a seller in displaying it or a buyer taking it home after buying will feel it bulky and inconvenient.

Therefore, some people designed such a spherical decorative lamp in a separated mode, an example is shown in the U.S. Pat. No. 5,645,343. As shown in FIG. 1, the spherical decorative lamp in the U.S. patent includes an upper and a lower receiving seat A, and a plurality of frame bars B for mounting lamps. A plurality of clamping crevices A1 corresponding in number to the frame bars B are provided on each receiving seat A with a plurality of enlarged chambers A2 in the rear portions thereof. The frame bars B are formed integrally each on one end thereof a connecting end B2 and on the shank thereof a clamping seat B1 to clamp lamps (not shown). The frame bars B can have their connecting ends B2 press connected in the enlarged chambers A2 of a receiving seat A and are clamped by the clamping crevices A1. Although such a structure can separate the constructing elements of the spherical decorative lamp to make it easy in packaging with smaller members which result smaller volume, it creates a lot of parts, a buyer shall assemble by himself the parts including positioning of lamps, connecting of the frame bars B and the receiving seats A, and this is a bothersome thing.

Therefore, there has been being a product of spherical decorative lamp which is in an assembled mode and is foldable, for example, the product type 2128 called Crystal sphere made by Minami International Co. This decorative lamp laps the ends of a plurality of frame bars one over another, a plurality of connecting axles are used to make pivotal connection for the frame bars in different levels, thereby, all the frame bars can be stretched out or folded about the pivot. However, such design of a spherical decorative lamp makes it bad as a real sphere by the frame bars in different levels, it is not good aesthetically when in use, and the frame bars can not be accurately fixed in their desired positions by pivotal connecting in different levels and further make an aesthetical flaw on the whole sphere.

SUMMARY OF THE INVENTION

The object of the present invention is to provide a decorative lamp structure having a plurality of lamps with a plurality of frame bars which can be folded up for packaging and storage with smaller volume in cooperation with upper and lower positioning disks in a primary in-position stage. When a user buys it, he can conveniently proceed to a second stage of pressing positioning to render the frame bars and the upper and lower positioning disks to combine and form a three dimensional shape, and to be able to fold up for storage.

To obtain the above stated object, the frame bars are provided on the upper and the lower ends thereof with bases with engaging pins thereon. These engaging pins are provided with elastic hook ends, and positioning flanges are provided respectively at a distance away from their corresponding elastic hook ends. The upper and lower positioning disks are provided with a plurality of opened chambers corresponding in number to the frame bars, these opened chambers are provided near the internal ends thereof with through holes each with a diameter being smaller than that of the corresponding one of the engaging pins. The engaging pins of the upper and lower positioning disks can have their lower elastic hook ends passed through the through holes, so that the engaging pins can have their shanks between the elastic hook ends and the flanges movably combined with the upper and lower positioning disks in the primary in-position stage. Thereby, the frame bars can each be rotated about the pivot erected in the primary in-position stage to fold up into a flat state. When the user detaches the package, stretches the frame bars in a contrary direction, and presses the positioning flanges to completely get through the through holes in the second stage of pressing positioning, the frame bars can thus form the desired lamp structure.

The above stated frame bars can be in the form of semi-circles with other arciform sections or can be in the form of sequential bending portions whereby decorative lamps of various shapes can be formed.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
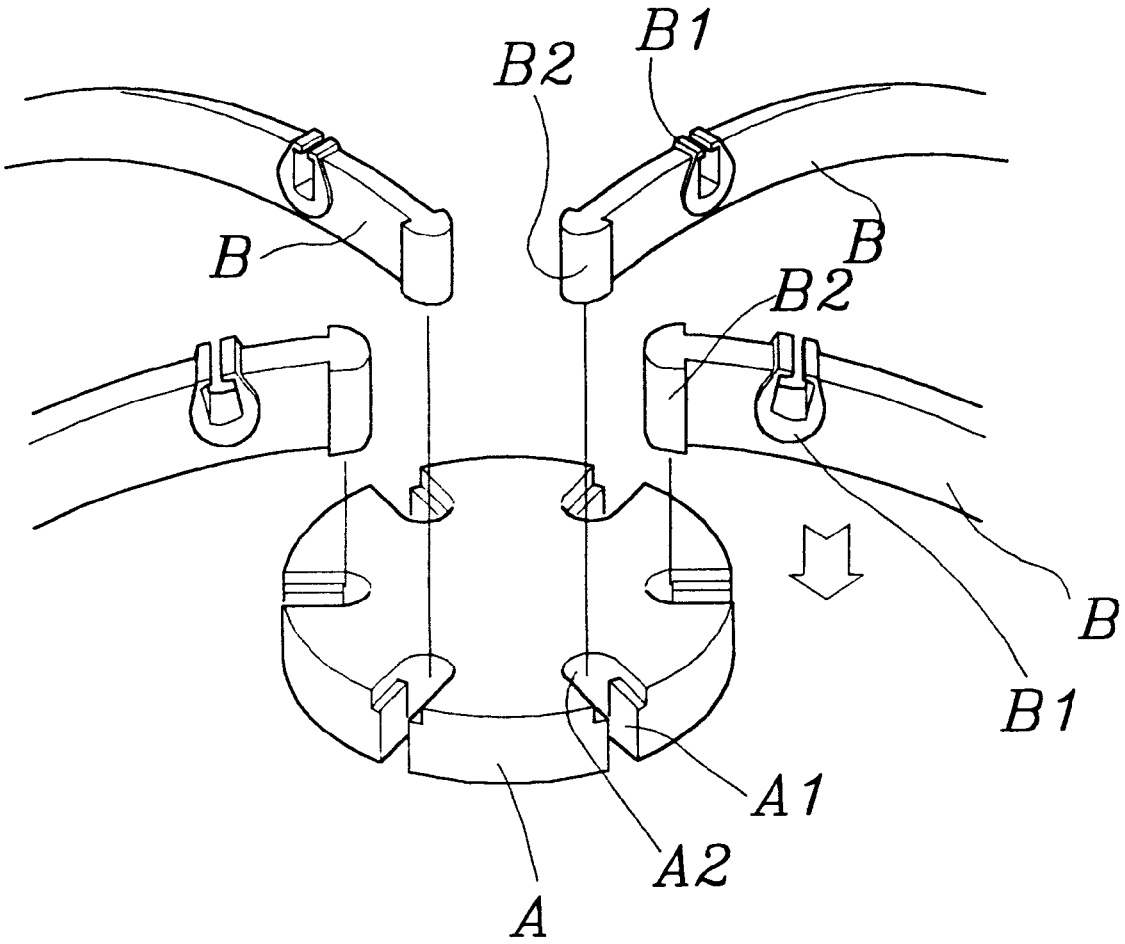
FIG. 1 PRIOR ART
FIG. 1 is an analytical perspective view of a conventional spherical lamp structure.
Figure 2:
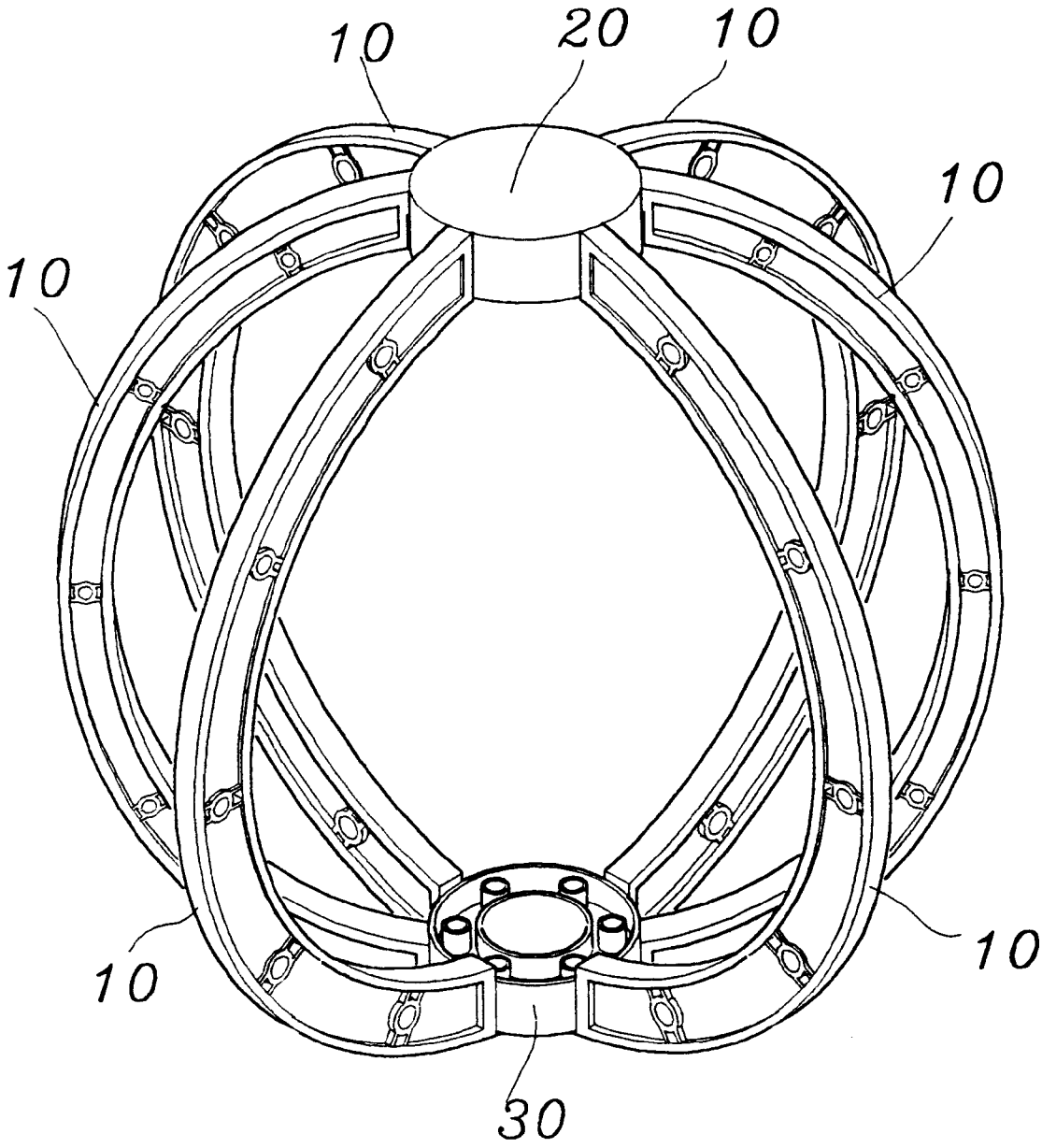
FIG. 2 is a perspective view of a first preferred embodiment of the present invention, wherein, the present invention has been assembled into a sphere.
Figure 3:
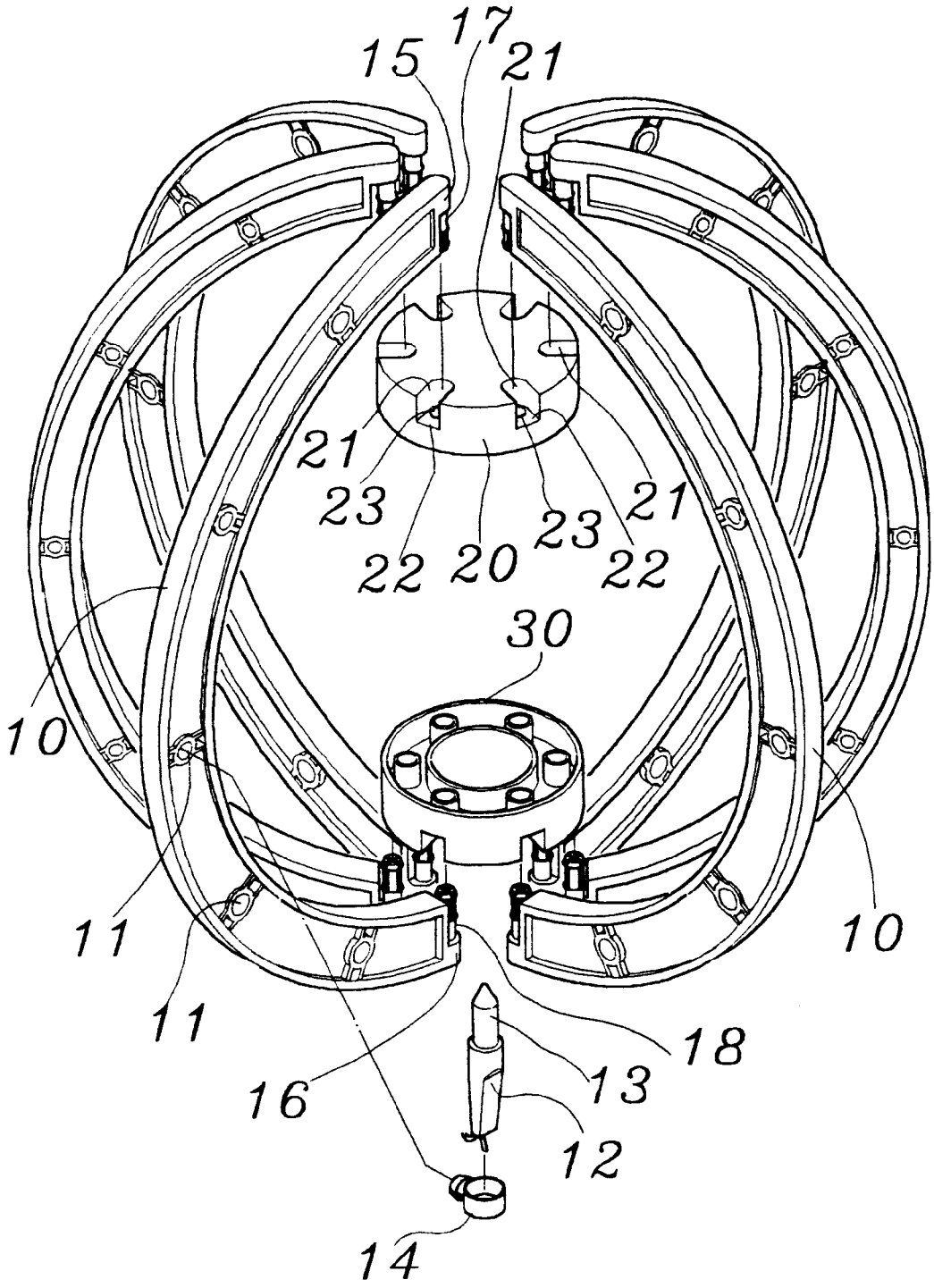
FIG. 3 is an analytical perspective view showing the main elements of the present invention.

Referring to FIGS. 2 and 3, the spherical lamp structure of the present invention is comprised of a plurality of frame bars 10, an upper positioning disk 20 and a lower positioning disk 30. In the embodiment shown, six semi-circular frame bars 10 are provided and equidistantly separated from one another to form the sphere.

The frame bars 10 in this embodiment are semi-circular as depicted, and a plurality of connecting holes 11 are provided thereon for mounting lamps 13 with lamp sockets 12. In this embodiment, each connecting hole 11 can be connected with a connecting piece 14 in advance. The connecting piece 14 is provided with an insertion portion for inserting into a hole 11, and a lamp socket 12 can then be connected to a through hole of the connecting piece 14. The statement above is only for illustrating, the lamps 13 can surely be connected in other ways with the frame bars 10.

Figure 4:
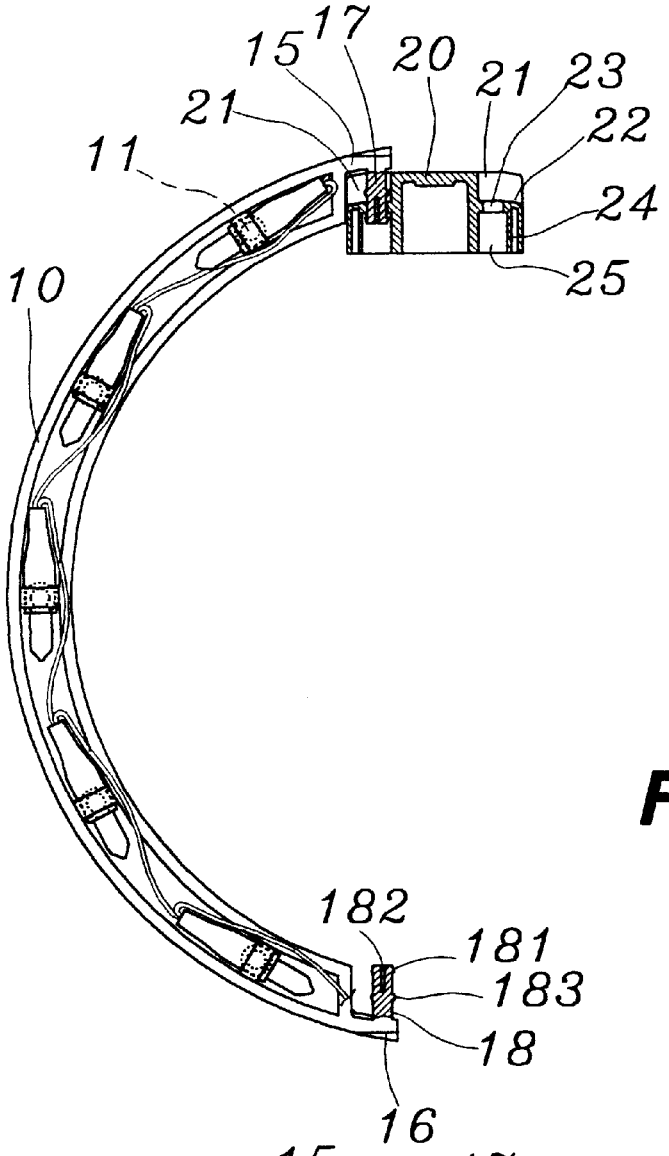
FIG. 4 is a partial enlarged plane view showing a single frame bar and a single positioning disk of the present invention in the primary in-position stage and showing a connecting area of them.

The upper and lower ends of each of the frame bars 10 are provided respectively with bases 15, 16 each with a thickness and a width smaller than those of the frame bar 10. The bases 15, 16 are prolonged integrally to form engaging pins 17, 18 of an identical shape. As shown in FIG. 4, the shanks of the engaging pins 17, 18 have suitable diameters, the ends thereof are conical ends 171, 181 with diameters slightly larger than those of the shanks and are provided each with a central crevice 172 (182) as an elastic hook end. And a positioning flange 173 (183) is provided on the other end a distance away from the corresponding one of the conical end 171 (181).

Referring particularly to FIGS. 3 and 4 simultaneously, the upper and the lower positioning disks 20, 30 are both made of plastic, they are now described taking the positioning disk 20 as a representative. The positioning disk 20 is provided with a plurality of recesses 21 near the periphery thereof in the number same as that of the frame bars 10; the depth of each of the recesses 21 is a half of that of the positioning disk 20. The inner bottom surface 22 of the recess 21 is provided with a through hole 23 extending through the positioning disk 20, the diameter of the through hole 23 is slightly larger than that of the engaging pins 17 (18). A hollow pipe 24 is formed on the other side of the bottom surface 22 of the recess 21 and has an inner hole 25 to communicate with the through hole 23. The diameter of the inner hole 25 is slightly larger than that of the through hole 23 to form a stop shoulder portion 26 (referring to FIG. 5).

Figure 9:
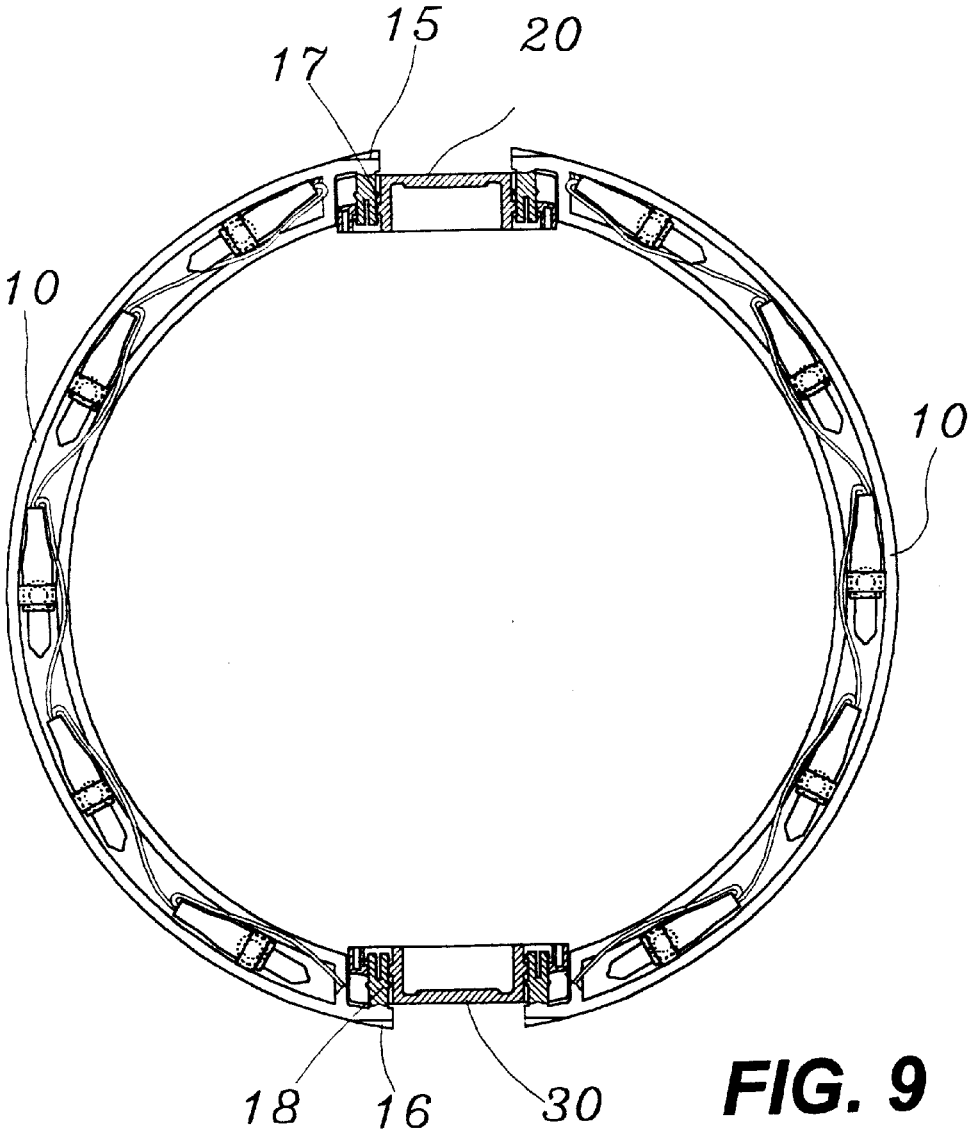
FIG. 9 is a front view showing the first preferred embodiment of the present invention being folded up into a flat state in the primary in-position stage.

As shown in FIGS. 4, 9, the engaging pins 17, 18 of the frame bar 10 are aligned in the first place respectively with any recess 21 on the upper positioning disk 20 and that on the lower positioning disk 30, the conical ends 171, 181 of the engaging pins 17, 18 are contracted by providing the central crevice 172, 182. When the conical ends 171, 181 are both extended through the corresponding through holes 23, they are elastically restored to their original open state. The upper and lower ends of the frame bars 10 form their primary in-position stage by providing the engaging pins 17, 18, the conical ends 171, 181 and the positioning flanges 173, 183 on the shanks stated above (as shown in FIGS. 4, 9). By virtue that the engaging pins 17, 18 form pivotal connections by positioning of the conical ends 171, 181 and the positioning flanges 173, 183 thereof on the through holes 23, the frame bars 10 connected with the upper and the lower positioning disks 20, 30 by such pivotal connections can be rotated to fold up and form the state as shown in FIG. 9 by the fact that the bases 15, 16 of the frame bars 10 are not totally pressed down yet over the surface of the upper and the lower positioning disks 20, 30. Thereby, the whole spherical lamp structure can be folded up into a flat smaller volume in favor of packaging, transporting and storage.

Figure 5:
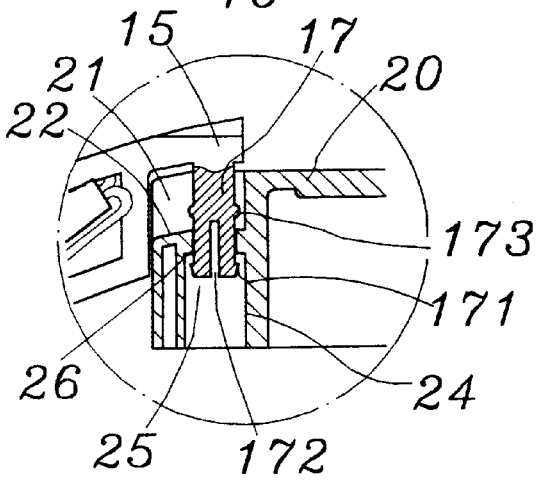
FIG. 5 is a partial further enlarged plane view showing the connecting area of FIG. 4.
Figure 6:
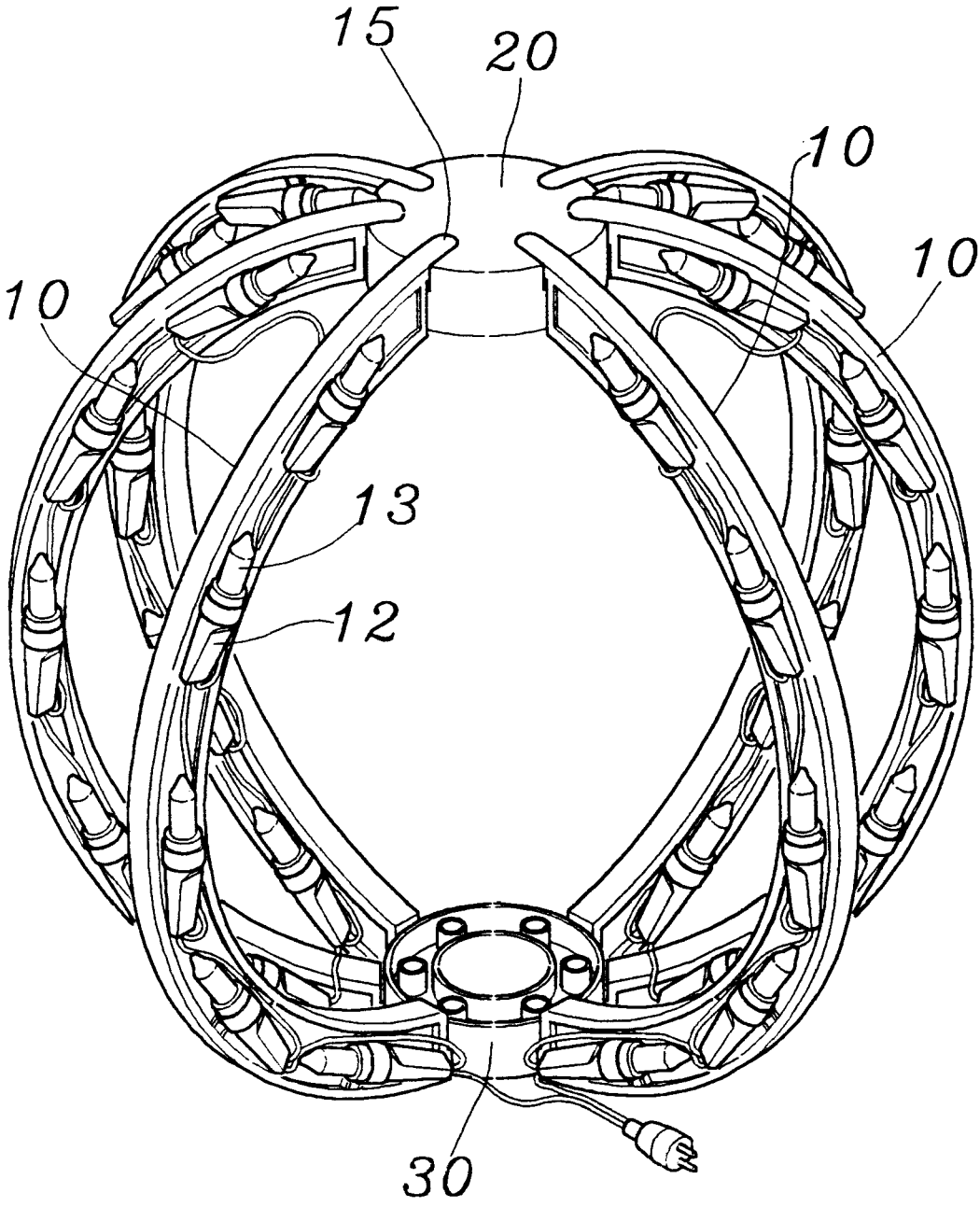
FIG. 6 is a perspective view showing the preferred embodiment of FIG. 2 being assembled.
Figure 7:
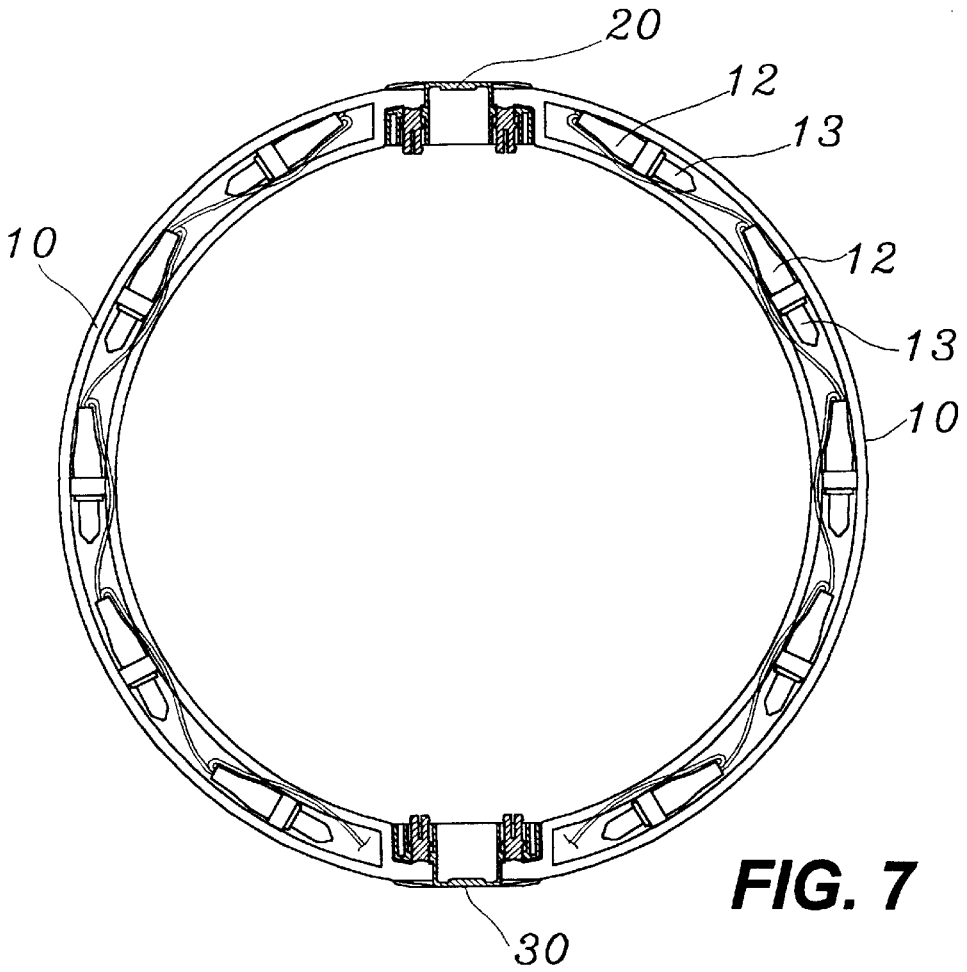
FIG. 7 is a front view of FIG. 6.
Figure 8:
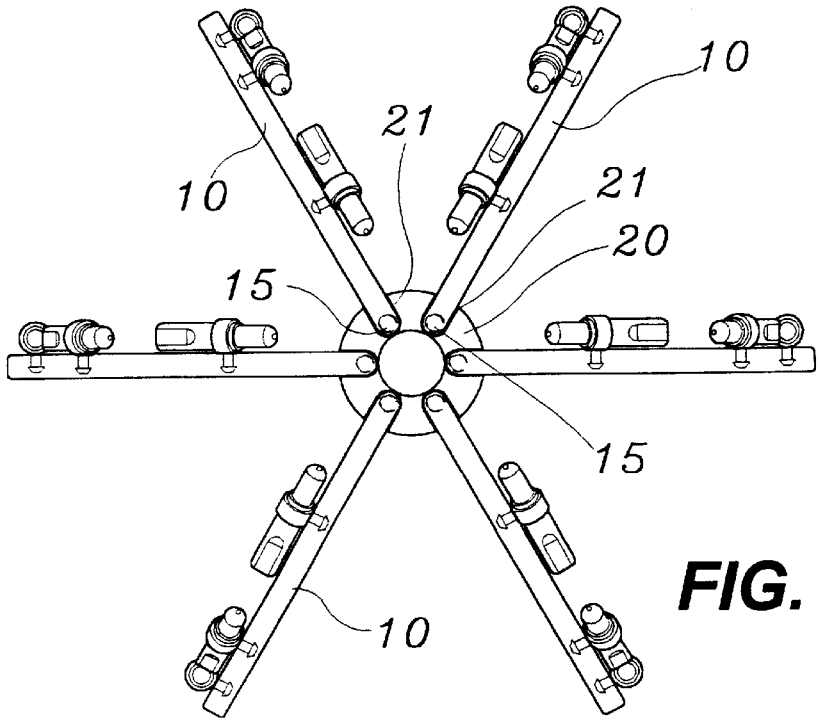
FIG. 8 is a top view of FIG. 7.
Figure 10:
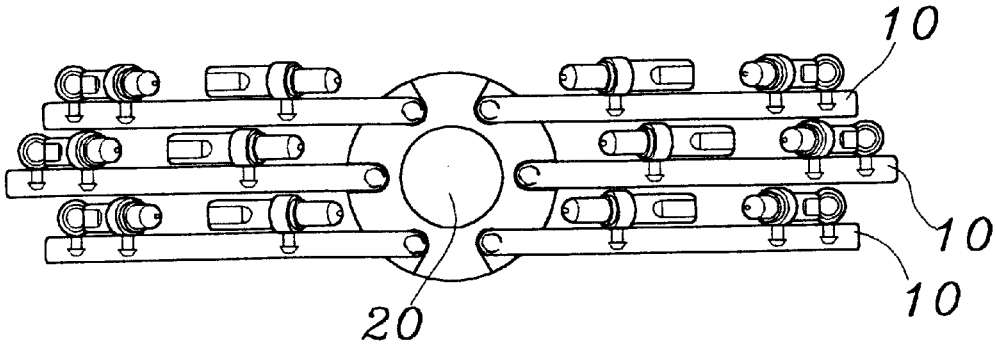
FIG. 10 is a top view of FIG. 9.

When it is to stretch out the spherical lamp structure from the storage state as shown in FIGS. 9 and 10, the frame bars 10 are rotated in a contrary direction to make consistence of the extending directions of the frame bars 10 with those of the recesses 21, then the engaging pins 17, 18 of the frame bars 10 are pressed down to make the positioning flanges 173, 183 get through the through holes 23. By virtue that the positioning flanges 173, 183 getting through the through holes 23 are stopped at the stop shoulder portions 26 in the inner holes 25 of the hollow pipes 24, fixed connection of the frame bars 10 can be obtained (as shown in FIGS. 5, 7 and 8). The bases 15, 16 of the engaging pins 17, 18 on the frame bars 10 thus are totally gotten into the recesses 21 to be flush with the surfaces of the upper and the lower positioning disks 20, 30. When all the frame bars 10 are proceeded to the second stage of pressing positioning in this mode, a perfect spherical lamp structure can be obtained as is shown in FIGS. 1, 5, 6 and 7.

Figure 11:
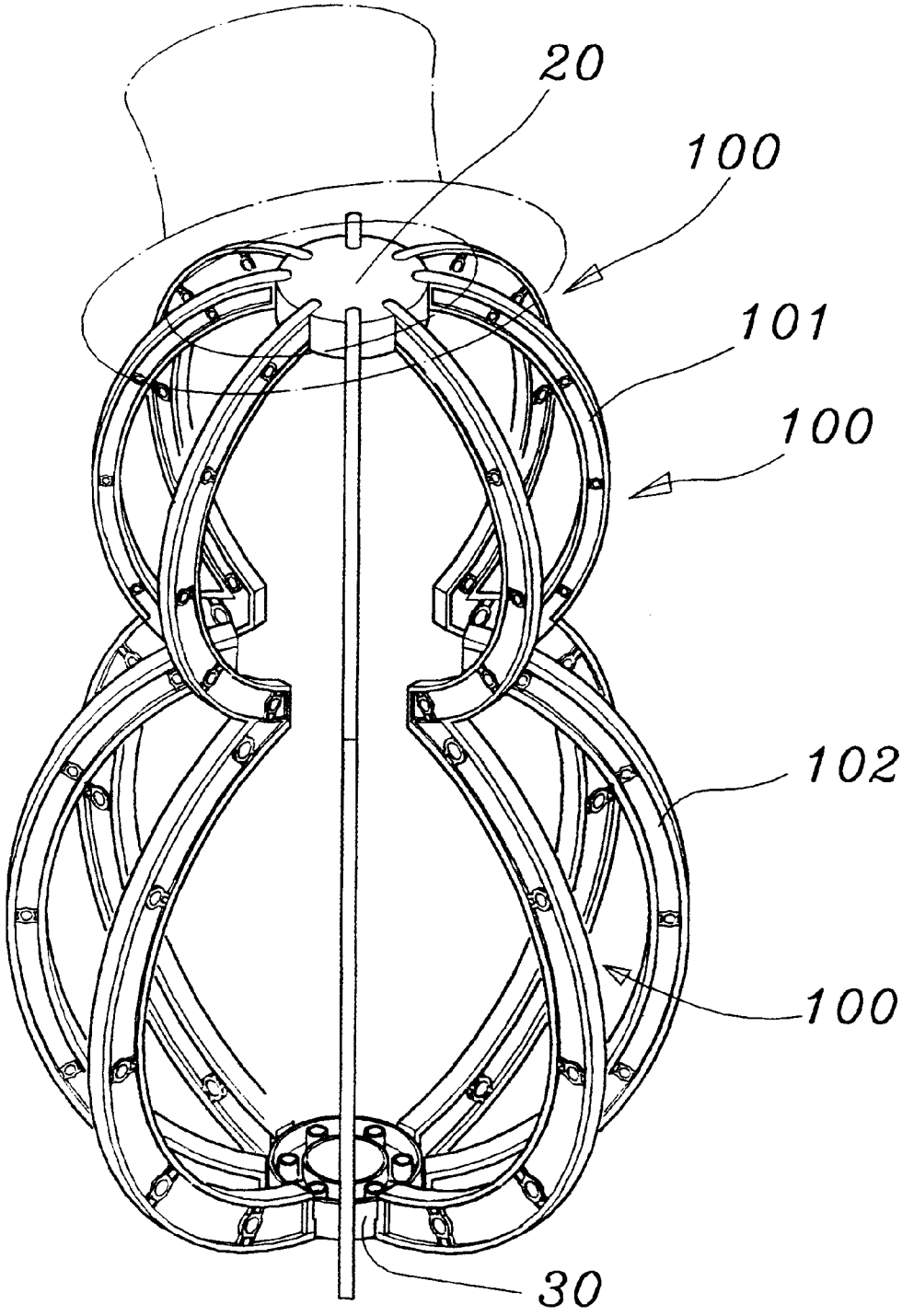
FIG. 11 is a perspective view of a second preferred embodiment of the present invention.
Figure 12:
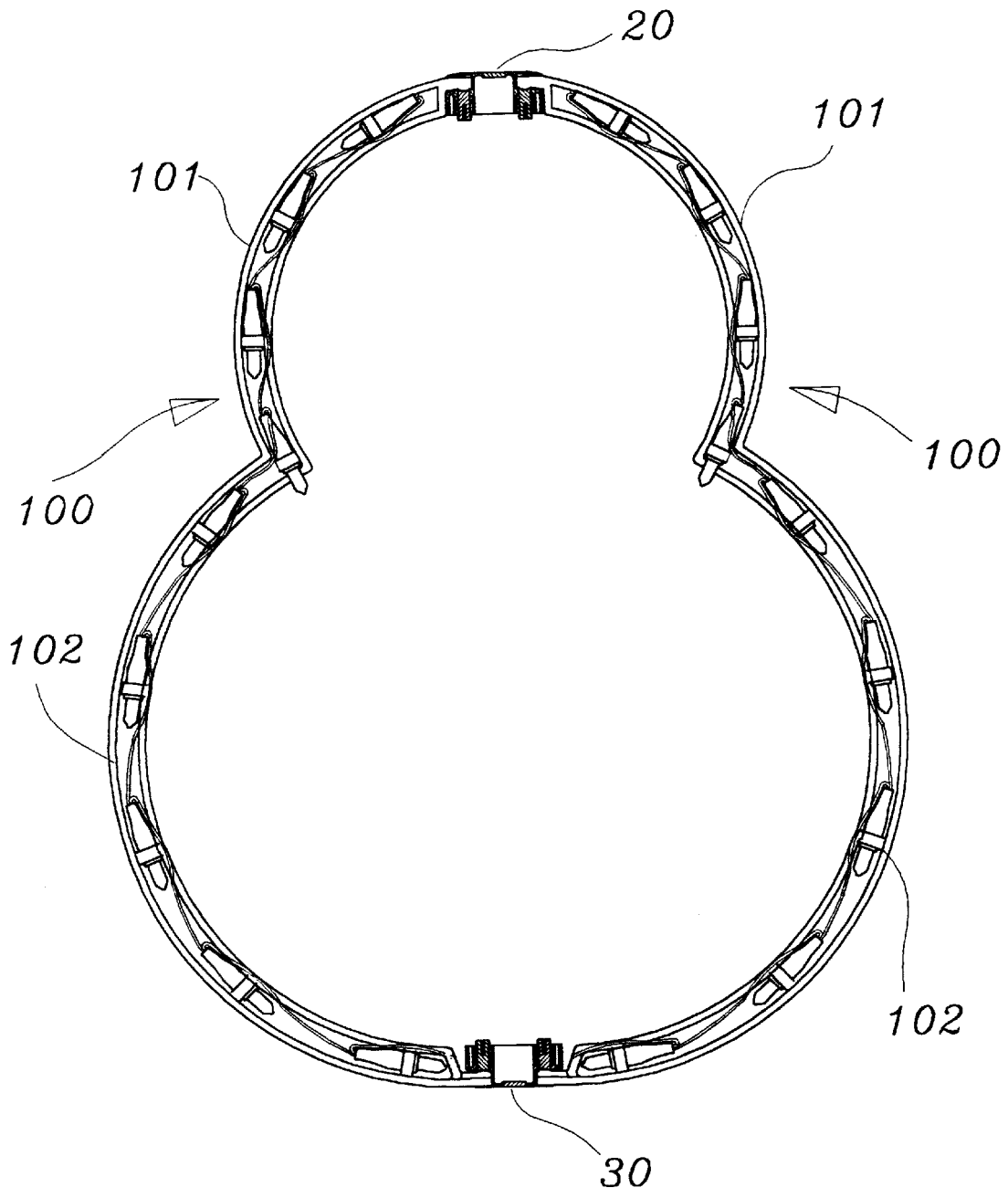
FIG. 12 is a sectional view taken from FIG. 11.
Figure 13:
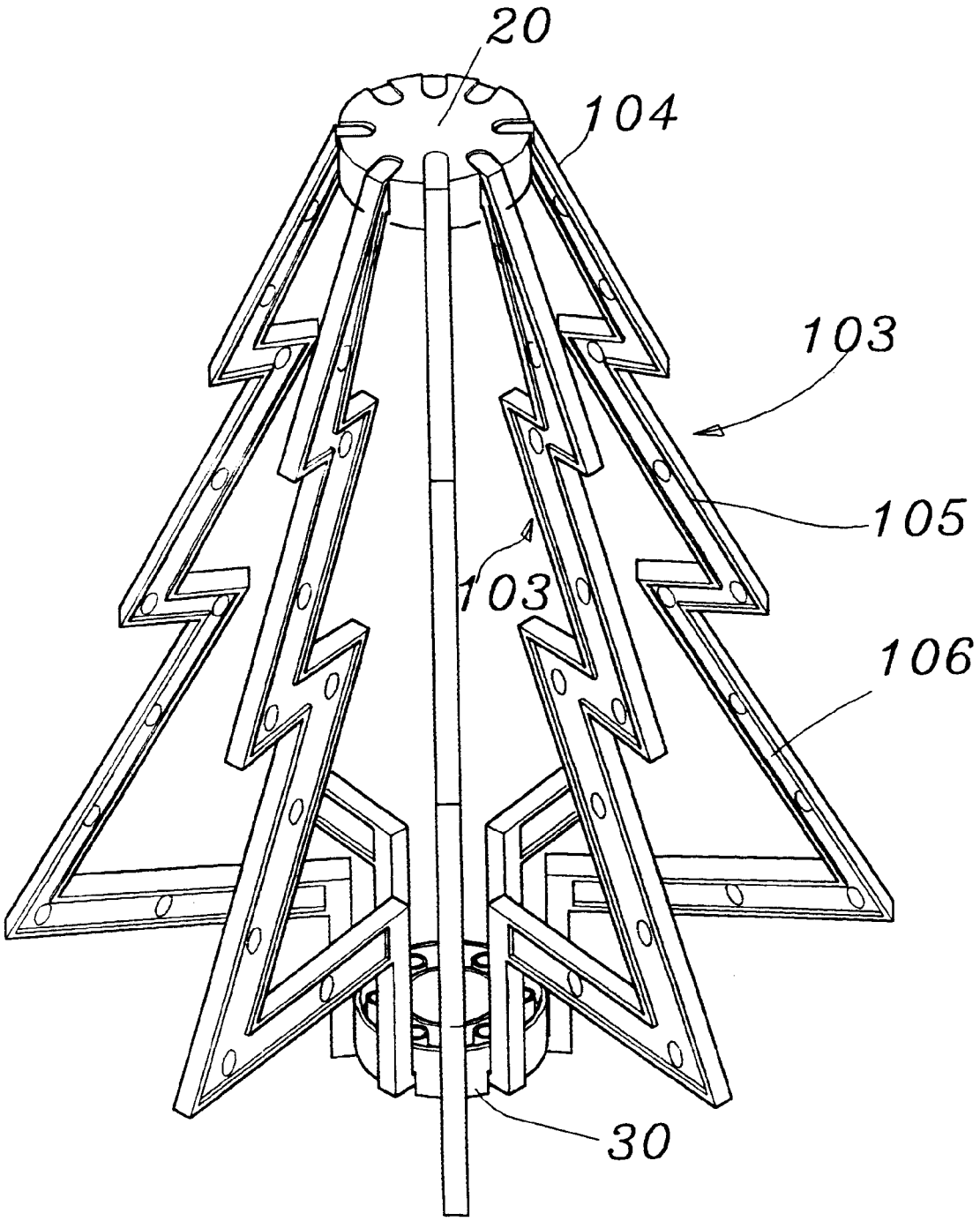
FIG. 13 is a perspective view of a third preferred embodiment of the present invention.
Figure 14:
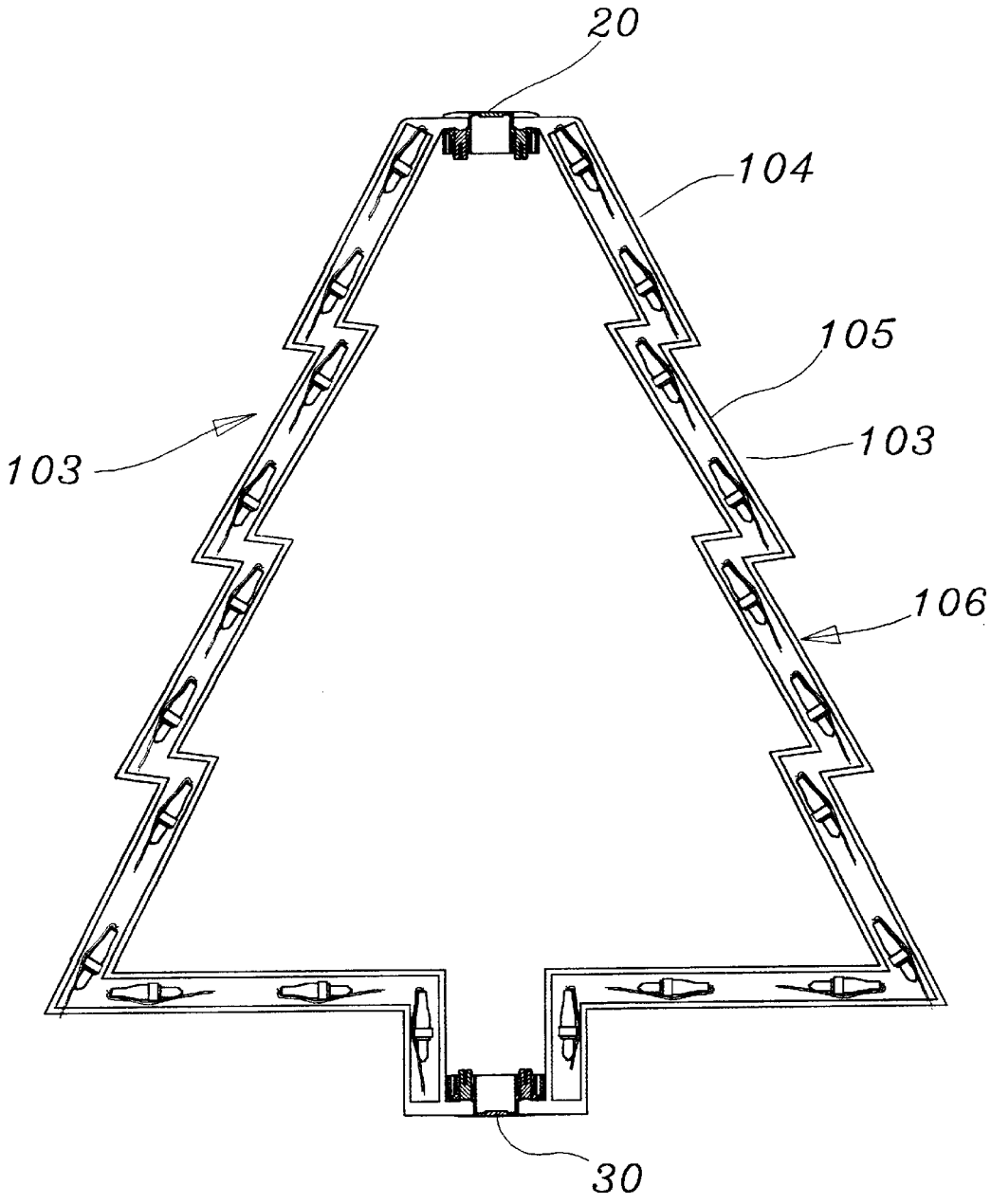
FIG. 14 is a sectional view taken from FIG. 13.

In the second embodiment of the present invention shown in FIGS. 11, 12, frame bars 100 are provided to have each an upper section 101 with a smaller radian and a lower section 102 with a larger radian. Such frame bars 100 can also be separately ejection molded as the aforesaid frame bars 10, and when they are connected with the upper and the lower positioning disks 20, 30, a decorative lamp structure in the shape of a snow man can be formed as are shown in FIGS. 11 12. While in the third embodiment of the present invention shown in FIGS. 13, 14, frame bars 103 are provided to be each has sequential bending portions 104, 105, 106 in continuity, they are connected with the upper and the lower positioning disks 20, 30 to form a decorative lamp structure in the shape of a Christmas tree.

The frame bars in the main elements of the stereo decorative lamp structure of the present invention can be combined with the upper and the lower positioning disks to form a whole unit, such an arrangement makes the decorative lamp structure foldable into smaller volume in favor of packaging, transporting and storage. Connecting of the frame bars with the upper and the lower positioning disks in this primary stage also makes a user convenient in fast assembling.

Having thus described my invention, what I claim as new and desire to be secured by Letters Patent of the United States are:

1. A decorative lamp structure comprising: a plurality of frame bars, each connected to an upper positioning disk and a lower positioning disk, said frame bars adapted to have a plurality of lamps thereon, said upper and lower positioning disks are of an identical shape and are provided with a plurality of recesses in the same number as the number of said frame bars, an inner bottom surface of each of said recesses provided with a through hole, said frame bars are each provided both on upper and lower ends thereof with a base having an integral engaging pin, said engaging pins pivotally engaging said recesses in a primary in-position stage and are fixedly connected in a second stage, said engaging pins each having a shank with a central crevice and a conical end to form an elastic hook end; a positioning flange is provided on said shank spaced from said conical end, wherein, said conical ends of said engaging pins extend through the corresponding through holes of said recesses such that the inner bottom surfaces are positioned between said conical ends and said positioning flanges in the primary in-position stage, and wherein, said engaging pins are pressed further into said recesses such that said positioning flanges pass completely through said through holes of said recesses in the second stage.

2. The decorative lamp structure as claimed in claim 1, wherein, said bases on said upper and lower ends of said frame bars each have a thickness and a width smaller than a thickness and a width of said frame bars, and said bases are located over said upper and the lower positioning disks in order to enable the frame bars to pivot for folding up in said primary in-position stage.

3. The decorative lamp structure as claimed in claim 1 wherein, said bases of said frame bars are flush with surfaces of said upper and the lower positioning disks when in said second stage.

4. The decorative lamp structure as claimed in claim 1 wherein, said upper and the lower positioning disks are provided beneath said through holes of said recesses with hollow pipes each having a diameter larger than a diameter of the corresponding one of said through holes to form a stop shoulder portion to stop against said positioning flanges.

* * * * *